United States Patent [19]

Alberti

[11] 3,981,078

[45] Sept. 21, 1976

[54] ELECTRIC KNIFE WITH GUIDE BLADE

[76] Inventor: Rosette Caroline Alberti, 7 Rue Marie Bonaparte, Saint Cloud (Hauts de Seine), France

[22] Filed: Nov. 17, 1975

[21] Appl. No.: 632,717

[30] Foreign Application Priority Data

Dec. 3, 1974 France ..... 74.39452

[52] U.S. Cl. ..... 30/293

[51] Int. Cl.[2] ..... B26B 29/02

[58] Field of Search..... 30/272 A, 283, 284, 30/293

[56] References Cited

UNITED STATES PATENTS

| | | | |
|---|---|---|---|
| 1,760,575 | 5/1930 | Anderson | 30/284 |
| 2,478,046 | 8/1949 | Higgs | 30/293 |
| 2,737,719 | 3/1956 | Ember | 30/283 |
| 2,938,269 | 5/1960 | Nissen | 30/272 A |
| 3,153,852 | 10/1964 | Freeman | 30/272 A |
| 3,178,817 | 4/1965 | Rubinstein | 30/293 |

*Primary Examiner*—Al Lawrence Smith
*Assistant Examiner*—J. C. Peters
*Attorney, Agent, or Firm*—Young & Thompson

[57] ABSTRACT

An electric knife has two mutually reciprocating cutting blades and an adjustably spaced guide blade. The guide blade is mounted on a cylindrical cap that slidably encloses a cylindrical sleeve fixed to the knife handle, and is rotatable about an axis defined by a threaded rod perpendicular to the planes of the blades and coaxial with the cap and sleeve. A knurled nut on the threaded rod holds the cylindrical cap against a coil compression spring which also acts as a torsion spring urging the guide blade downwardly relative to the cutting blades against an abutment that also serves as a gauge for the thickness of the slices to be cut, manipulation of this knurled nut effecting this adjustment.

2 Claims, 3 Drawing Figures

ELECTRIC KNIFE WITH GUIDE BLADE

The present invention relates to improvements in electric knives.

Conventional electric knives are comprised by two blades whose lower portion is generally serrated, connected to each other and driven with relative longitudinal reciprocatory movement. These electric knives have a number of drawbacks. In particular, with this type of knife, it is difficult to cut slices all the same thickness and, because the cut off slice is not guided, each slice will not have a constant thickness.

It has already been proposed to provide such knives with guide blades parallel to the cutting blades and spaced an adjustable distance from the cutting blades. However such guide blades are complicated and either do not insure an exact positioning of the cutting blades in use because they do not extend below the cutting blades or do not permit cutting through the entire thickness of the piece to be cut because they are not retractable.

The present invention has for its object to overcome these drawbacks and to this end provides an electric knife of the type comprising two cutting blades in contact with each other driven with alternate relative movement, and a guide blade parallel to the cutting blades and spaced an adjustable distance from the cutting blades, the guide blade being mounted for rotation about an axis perpendicular to the plane of the blades, characterized in that the guide blade is urged toward a spacing and in a direction to bring its lower edge below the edge of the cutting blades, by a helical spring mounted about the axis of rotation of the guide blade and acting between the handle of the knife and the base of the guide blade, with means to compress the helicoidal spring and an abutment perpendicular to the plane of the guide blade limiting the rotation of the latter under the action of the helicoidal spring so that its lower edge will be located below the edges of the cutting blades.

According to another feature of the present invention, the base of the guide blade is constituted by a cylindrical cap that slidably fits on a cylindrical sleeve fixed to the handle of the knife, the helicoidal spring being disposed in the interior of the casing formed by these two elements and the compression means of the helicoidal spring being constituted by an axial threaded rod with a knurled nut threaded on this rod and bearing against the top of the cylindrical cap.

According to a secondary feature of the present invention, the abutment is constituted by a blade fixed to the cylindrical sleeve and bearing a graduated scale permitting evaluation of the distance between the guide blade and the cutting blades.

The present invention will be better understood from a consideration of the following description of one embodiment thereof, taken in connection with the accompanying drawing, in which.

Figure 1:
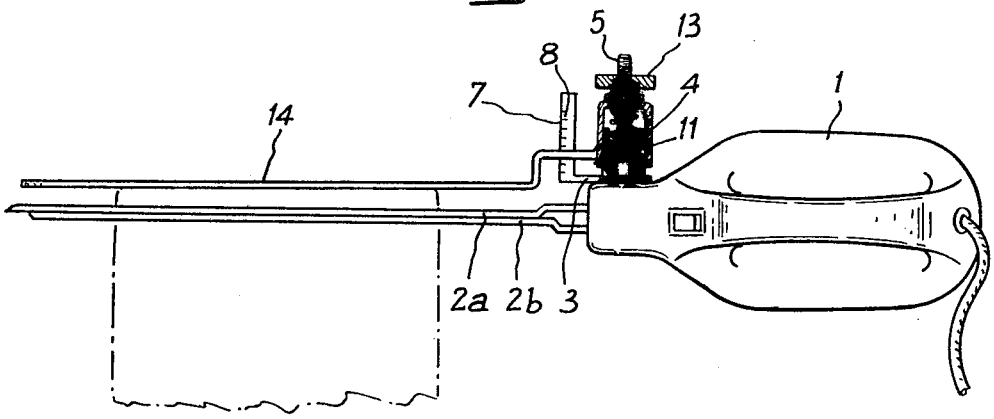
FIG. 1 is a plan view partly in cross section of an electric knife constructed in accordance with the present invention.
Figure 2:
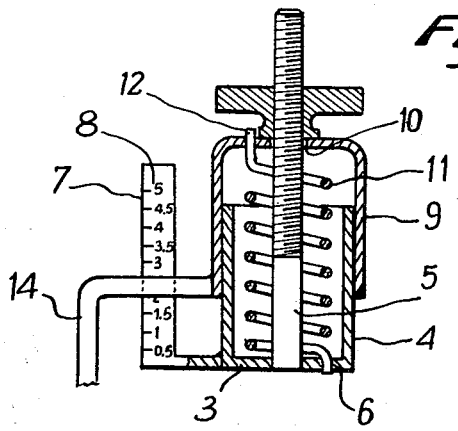
FIG. 2 is an enlarged cross-sectional detail view of a part of the device shown in FIG. 1.
Figure 3:
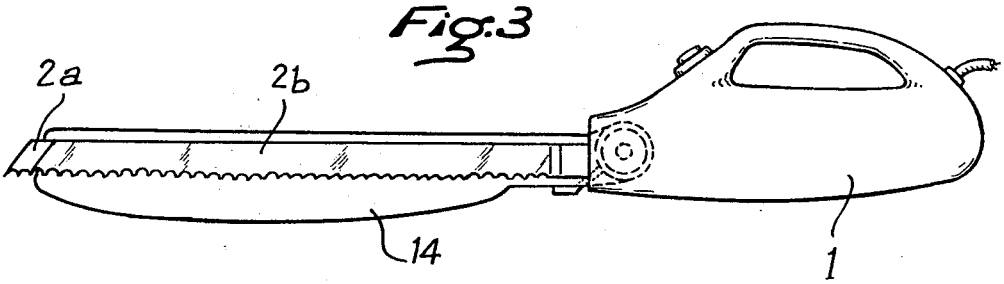
FIG. 3 is an elevational view of an electric knife constructed in accordance with the present invention.

As shown in FIGS. 1, 2 and 3, the electric knife according to the present invention is comprised by a handle or body 1 forming a casing for the electric motor and in which are secured the two cutting blades 2*a* and 2*b*. On the side of the body 1 comprising the casing is mounted the base 3 carrying a cylindrical sleeve 4 having a coaxial threaded rod 5 extending therethrough whose length is substantially greater than that of the cylindrical sleeve 4, there being an annular space between the sleeve 4 and the rod 5. The base 3 also carries a lateral bracket 7 parallel to sleeve 4, the upper surface of bracket 7 having thereon a millimeter scale 8.

A cylindrical cap 9 slides on cylindrical sleeve 4 and has an internal diameter substantially equal to the external diameter of cylindrical sleeve 4. In the upper part of cap 9 a hole 10 is provided to permit free passage of the threaded rod 5. A coil compression and torsion spring 11 surrounds rod 5 and extends also into the space between rod 5 and sleeve 4, one end of spring 11 being secured to base 3 by lodgment in a hole 6 in base 3 and the other end 12 of spring 11 being secured to cap 9 by lodgment in a hole in cap 9. A knurled nut 13 threaded on rod 5 maintains cap 9 on sleeve 4 against the action of spring 11.

A guide blade 14 is secured to cap 9 and extends perpendicular to the axis of cap 9 and parallel to the cutting blades 2*a* and 2*b*. Guide blade 14 rests on bracket 7 which thus limits downward displacement of blade 14 under the action of spring 11 which acts as a torsion spring, urging sleeve 9 in a direction to apply guide blade 14 against bracket 7. When guide blade 14 strikes a hard body, for example a platter on which the piece to be cut rests, the guide blade 14 secured to cylindrical cap 9 will turn on cylindrical sleeve 4 against the action of spring 11 and thus be permitted to swing upwardly relative to blades 2*a* and 2*b*.

Moreover, to regulate the distance between the cutting blades 2*a* and 2*b* in the guide blade 14, the cylindrical cap 9 may be slid on and relative to cylindrical sleeve 4 as a function of the compression of spring 11 by screwing knurled nut 13 in one direction or the other on threaded rod 5, the thickness of the slice to be cut being read on scale 8.

From a consideration of the foregoing disclosure, therefore, it will be evident that the initially recited object of the present invention has been achieved.

Although the present invention has been described and illustrated in connection with a preferred embodiment, it is to be understood that modifications and variations may be resorted to without departing from the spirit of this invention, as those skilled in this art will readily understand. Such modifications and variations are considered to be within the purview and scope of the present invention as defined by the appended claims.

What is claimed is:

1. An electric knife comprising two cutting blades that slide in contact with each other with alternate reciprocating movement, a handle, a guide blade parallel to and spaced from the cutting blades, means mounting said guide blade for swinging movement relative to the cutting blades about an axis perpendicular to the planes of the cutting blades, and means resiliently urging said guide blade to rotate about said axis downwardly relative to the cutting blades, said guide blade mounting and urging means comprising a cylindrical sleeve secured to said handle, a cylindrical cap slidable and rotatable on said sleeve, a coil compression and torsion spring within said cap and sleeve, one end of said coil compression spring being fixed relative to said handle, the other end of said coil compression spring being fixed relative to said cap, a screw-threaded rod coaxial within said cap and sleeve and spring and perpendicular to said cutting blades, a nut screw-threadedly disposed on said rod and bearing on the outer side of said cylindrical cap to slide said cap axially on said sleeve, said guide blade being secured to said cap, and an abutment on which said guide blade slides and against which said guide blade is urged by the torsion of said spring.

2. An electric knife as claimed in claim 1, and a scale on said abutment extending in a direction parallel to said threaded rod to determine the spacing between said guide blade and said cutting blades.

* * * * *